US010047327B2

(12) United States Patent
Keuleers et al.

(10) Patent No.: US 10,047,327 B2
(45) Date of Patent: Aug. 14, 2018

(54) WATER SOLUBLE UNIT DOSE ARTICLE

(71) Applicant: The Procter & Gamble Company, Cincinnati, OH (US)

(72) Inventors: Robby Renilde Francois Keuleers, Lippelo (BE); Regine Labeque, Neder over Heembeek (BE); Stefan Schittko, Overijse (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/421,458

(22) Filed: Feb. 1, 2017

(65) Prior Publication Data

US 2017/0226447 A1 Aug. 10, 2017

(30) Foreign Application Priority Data

Feb. 5, 2016 (EP) ..... 16154494
Oct. 7, 2016 (EP) ..... 16192899

(51) Int. Cl.

| | |
|---|---|
| ***C11D 11/00*** | (2006.01) |
| ***C11D 3/37*** | (2006.01) |
| ***C11D 17/04*** | (2006.01) |
| ***C11D 3/20*** | (2006.01) |
| ***C11D 1/22*** | (2006.01) |
| ***C11D 1/29*** | (2006.01) |
| ***C11D 1/66*** | (2006.01) |
| ***C11D 3/30*** | (2006.01) |

(52) U.S. Cl.

CPC ..... *C11D 11/0017* (2013.01); *C11D 1/22* (2013.01); *C11D 1/29* (2013.01); *C11D 1/66* (2013.01); *C11D 3/2044* (2013.01); *C11D 3/2065* (2013.01); *C11D 3/2068* (2013.01); *C11D 3/2075* (2013.01); *C11D 3/30* (2013.01); *C11D 3/3753* (2013.01); *C11D 17/045* (2013.01)

(58) Field of Classification Search

None

See application file for complete search history.

(56) References Cited

U.S. PATENT DOCUMENTS

| | | | |
|---|---|---|---|
| 2005/0119150 | A1 | 6/2005 | Pegelo et al. |
| 2005/0205574 | A1 | 9/2005 | Lambotte et al. |
| 2012/0175797 | A1 | 7/2012 | Labeque et al. |
| 2015/0336692 | A1 | 11/2015 | Brandt Sanz et al. |
| 2016/0355762 | A1 | 12/2016 | Brooker et al. |

FOREIGN PATENT DOCUMENTS

| | | | |
|---|---|---|---|
| EP | 1400460 | * | 3/2004 |
| EP | 1400460 | A1 | 3/2004 |
| EP | 2 476 744 | A1 | 7/2012 |
| EP | 2 865 741 | A1 | 4/2015 |
| EP | 2 865 742 | A1 | 4/2015 |

OTHER PUBLICATIONS

European Search Report for International application No. 16154490.3-1375, dated Aug. 19, 2016, 12 pages.

European Search Report Application No. 16154494.5-1375, dated Aug. 19, 2016, 7 pages.

U.S. Appl. No. 15/421,456, filed Feb. 1, 2017, Robby Renilde Francois Keuleers.

PCT Search Report for application No. PCT/US2017/015922, dated May 9, 2017, 129 pages.

* cited by examiner

*Primary Examiner* — Necholus Ogden, Jr.

(74) *Attorney, Agent, or Firm* — Gregory S. Darley-Emerson

(57) ABSTRACT

Water-soluble unit dose article comprising a water-soluble film and a liquid laundry detergent composition, wherein the liquid laundry detergent composition comprises; a) an anionic surfactant; b) a non-ionic surfactant; c) 1,2-propanediol; d) dipropylene glycol.

15 Claims, No Drawings

WATER SOLUBLE UNIT DOSE ARTICLE

FIELD OF THE INVENTION

The present invention relates to water-soluble unit dose articles comprising liquid laundry detergent compositions and their method of use.

BACKGROUND OF THE INVENTION

Liquid laundry detergent compositions are available in the form of water-soluble unit dose articles. Such water-soluble unit dose articles are preferred by consumers as they are convenient to use and reduce accidental spillage during detergent dosage in the wash operation.

Such water-soluble unit dose articles comprise a water-soluble film, preferably a polyvinylalcohol containing film that is formed into a pouch comprising an internal compartment. The liquid laundry detergent composition is comprised within the internal compartment such that the liquid laundry detergent composition is surrounded by the film and in contact with the film that forms the inner surface of the internal compartment.

Upon manufacture of the film, it has certain dissolution and tensile properties. Careful balance of the film plasticization properties are needed to ensure the film is not too 'floppy' affecting its dissolution characteristics in water, and not too brittle, leading to unwanted premature rupture of the unit dose article ahead of use. This plasticization of the film can be negatively affected by contact with the liquid detergent over time.

Therefore, there is a need for a liquid laundry detergent article whereby the plasticization properties of the film as manufactured are minimally affected by contact with the liquid detergent over time.

It was surprisingly found that the presence of 1,2-propanediol and dipropylene glycol in specific ratio to one another in the liquid laundry detergent composition addressed this technical problem.

It was further surprisingly found that careful balance of the ratio of anionic and nonionic surfactant in the presence of the 1,2-propanediol and dipropylene glycol provided improved stability of the liquid laundry detergent composition within the unit dose article.

SUMMARY OF THE INVENTION

A first aspect of the present invention is a water-soluble unit dose article comprising a water-soluble film comprising at least one polyvinylalcohol or a copolymer thereof and a liquid laundry detergent composition, wherein the liquid laundry detergent composition comprises;

a. between 30% and 43% by weight of the liquid laundry detergent composition of an anionic surfactant;
b. A non-ionic surfactant;
c. 1,2-propanediol;
d. Dipropylene glycol;

wherein the total weight percentage of the 1,2-propanediol and dipropylene glycol is between 5% and 25% by weight of the liquid laundry detergent composition, and wherein the weight ratio of 1,2-propanediol to dipropylene glycol is between 1:1 and 10:1.

A second aspect of the present invention is a process of washing fabrics comprising the steps of contacting the unit dose article with water such that the liquid laundry detergent composition is diluted in water by at least 400 fold to form a wash liquor, and contacting fabrics with said wash liquor.

A third aspect of the present invention is a use of a liquid laundry detergent composition, wherein the liquid laundry detergent composition comprises;

a. between 30% and 43% by weight of the liquid laundry detergent composition of an anionic surfactant;
b. a non-ionic surfactant;
c. 1,2-propanediol;
d. dipropylene glycol;

wherein the total weight percentage of the 1,2-propanediol and dipropylene glycol is between 5% and 25% by weight of the liquid laundry detergent composition, and wherein the weight ratio of 1,2-propanediol to dipropylene glycol is between 1:1 and 10:1, preferably between 1:1 to 5:1, most preferably between 2:1 to 4:1 in a water-soluble unit dose article comprising a water-soluble film comprising at least one polyvinylalcohol or a copolymer thereof, to control the plasticization of said water-soluble film.

DETAILED DESCRIPTION OF THE INVENTION

Water-Soluble Unit Dose Article

The present invention is related to a water-soluble unit dose article comprising a water-soluble film comprising at least one polyvinylalcohol or a copolymer thereof and a liquid laundry detergent composition.

The liquid laundry detergent composition and the water-soluble film are described in more detail below.

The water-soluble unit dose article comprises at least one water-soluble film shaped such that the unit-dose article comprises at least one internal compartment surrounded by the water-soluble film. The at least one compartment comprises the liquid laundry detergent composition. The water-soluble film is sealed such that the liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the liquid laundry detergent. Preferably, the unit dose article comprises a water-soluble film. The unit dose article is manufactured such that the water-soluble film completely surrounds the liquid laundry detergent composition and in doing so defines the compartment in which the liquid laundry detergent resides. The unit dose article may comprise two films. A first film may be shaped to comprise an open compartment into which the liquid laundry detergent is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the first liquid laundry detergent according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the liquid laundry detergent composition is comprised in at least one of the compartments.

Liquid Laundry Detergent Composition

The liquid laundry detergent composition comprises;

a. an anionic surfactant;

b. a non-ionic surfactant;

c. 1,2-propanediol;

d. dipropylene glycol.

The total weight percentage of the 1,2-propanediol and dipropylene glycol is between 5% and 25% by weight of the liquid laundry detergent composition.

Dipropylene glycol and 1,2-propanediol are commercially available materials and any commercial available 1,2-propanediol and dipropylene glycol is suitable for the present invention. Those skilled in the art will know how and where to source such materials. Dipropylene glycol is commercially available from Dow Chemical Company headquartered in Michigan, USA, or Adeka Corporation with headquarters in Tokyo, Japan.

The weight ratio of 1,2-propanediol to dipropylene glycol is between 1:1 and 10:1, preferably between 1:1 and 5:1, most preferably between 2:1 and 4:1 Preferably, the total weight percentage of 1,2-propanediol and dipropylene glycol is between 10% and 20%, most preferably between 13 and 17%.

Preferably, the liquid laundry detergent composition comprises between 30% and 43%, preferably between 34% and 40% by weight of the composition of the anionic surfactant. The anionic surfactant is described in more detail below.

Preferably, the ratio of anionic surfactant to non-ionic surfactant is 5:1 and 15:1, preferably between 7:1 and 12:1. The non-ionic surfactant is described in more detail below.

The liquid laundry detergent composition may comprise a fatty acid or salt thereof. Preferably, the liquid laundry detergent composition comprises between 3% and 10%, more preferably between 5% and 7% by weight of the liquid laundry detergent composition of a fatty acid or salt thereof. The fatty acid or salt thereof is described in more detail below.

Preferably the water-soluble unit dose article comprises between 0.5% and 20%, more preferably between 1% and 15%, most preferably between 5% and 12% by weight of the unit dose article of water.

The liquid laundry detergent composition may comprise glycerol, preferably wherein the glycerol is present between 2 and 10%, more preferably between 3% and 5% by weight of the liquid laundry detergent composition.

The liquid laundry detergent composition may comprise an alkanolamine, preferably the alkanolamine comprises monoethanolamine, triethanolamine or a mixture thereof, most preferably the alkanolamine comprises monoethanolamine. Preferably, the liquid laundry detergent composition comprises between 5% and 15%, more preferably between 8% and 12% by weight of the liquid laundry detergent composition of the alkanolamine, preferably of monoethanolamine, triethanolamine or a mixture thereof, most preferably of monoethanolamine.

Preferably, the liquid laundry detergent composition has a pH between 6 and 10, more preferably between 6.5 and 8.9, most preferably between 7 and 8. The pH of the liquid laundry detergent composition may be measured as a 10% dilution in demineralized water at 20° C.

Without wishing to be bound by theory, it is believed that it is the presence specifically of 1,2-propanediol and dipropylene glycol at a specific ratio to one another that ensures the film properties, especially film plasticization properties, are maintained upon interaction with the liquid laundry detergent composition over time. By 'plasticization' we herein mean the flexibility characteristics of the film. If the film is over plasticized it becomes 'floppy' and exhibits reduced dissolution in water. If the film is under plasticized then it becomes brittle and prone to structural failure, such as tearing or splitting. Upon interaction of the film with the liquid laundry detergent composition, the plasticization properties of the film are affected over time.

Anionic Surfactant

Preferably, the anionic surfactant is selected from linear alkylbenzene sulphonate, alkyl sulphate, alkoxylated alkyl sulphate or a mixture thereof.

Preferably, the anionic surfactant comprises alkylbenzene sulphonate and alkoxylated alkyl sulphate, wherein the weight ratio of alkylbenzene sulphonate to alkoxylated alkyl sulphate is between 3:1 and 1:1, more preferably between 2:1 and 1:1. More preferably, the anionic surfactant comprises alkylbenzene sulphonate and ethoxylated alkyl sulphate, wherein the weight ratio of alkylbenzene sulphonate to ethoxylated alkyl sulphate is between 3:1 and 1:1, more preferably between 2:1 and 1:1.

Preferably, the liquid laundry detergent composition comprises between 30% and 43%, preferably between 34% and 40% by weight of the composition of the anionic surfactant. For the avoidance of any doubt, by 'weight percentage of the anionic surfactant' we herein mean the weight percentage of all anionic surfactant present. For example, wherein the composition comprises linear alkylbenzene sulphonate and alkoxylated alkyl sulphate the weight percentage of the anionic surfactant is the sum of the weight percentage of linear alkyl benzene sulphonate and the weight percentage of alkoxylated alkyl sulphate.

In accordance with the present invention the term 'anionic surfactant' does not include fatty acids or their corresponding salt (soap).

Suitable anionic surfactants useful herein can comprise any of the conventional anionic surfactant types typically used in liquid detergent products. These include the alkyl benzene sulfonic acids and their salts as well as alkoxylated or non-alkoxylated alkyl sulfate materials.

Exemplary anionic surfactants are the alkali metal salts of $C_{10}$-$C_{16}$ alkyl benzene sulfonic acids, or $C_{11}$-$C_{14}$ alkyl benzene sulfonic acids. In one aspect, the alkyl group is linear and such linear alkyl benzene sulfonates are known as "LAS". Alkyl benzene sulfonates, and particularly LAS, are well known in the art. Especially useful are the sodium, potassium and amine linear straight chain alkylbenzene sulfonates in which the average number of carbon atoms in the alkyl group is from about 11 to 14.

Specific, non-limiting examples of anionic surfactants useful herein include the acid or salt forms of: a) $C_{11}$-$C_{18}$ alkyl benzene sulfonates (LAS); b) $C_{10}$-$C_{20}$ primary, branched-chain and random alkyl sulfates (AS), including predominantly $C_{12}$ alkyl sulfates; c) $C_{10}$-$C_{18}$ secondary (2,3) alkyl sulfates with non-limiting examples of suitable cations including sodium, potassium, ammonium, amine and mixtures thereof; d) $C_{10}$-$C_{18}$ alkyl alkoxy sulfates ($AE_xS$) wherein x is from 1-30; e) $C_{10}$-$C_{18}$ alkyl alkoxy carboxylates in one aspect, comprising 1-5 ethoxy units; f) mid-chain branched alkyl sulfates; g) mid-chain branched alkyl alkoxy sulfates; h) modified alkylbenzene sulfonate; i) methyl ester sulfonate (MES); and j) alpha-olefin sulfonate (AOS).

Non-Ionic Surfactant

The non-ionic surfactant is selected from a fatty alcohol alkoxylate, an oxo-synthesised fatty alcohol alkoxylate, Guerbet alcohol alkoxylates, alkyl phenol alcohol alkoxylates or a mixture thereof.

The nonionic surfactant may comprise an ethoxylated nonionic surfactant. The ethoxylated nonionic surfactant may be, e.g., primary and secondary alcohol ethoxylates, especially the $C_8$-$C_{20}$ aliphatic alcohols ethoxylated with an average of from 1 to 50 or even 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

The ethoxylated alcohol non-ionic surfactant can be, for example, a condensation product of from 3 to 8 mol of ethylene oxide with 1 mol of a primary alcohol having from 9 to 15 carbon atoms.

The non-ionic surfactant may comprise a fatty alcohol ethoxylate of formula $RO(EO)_nH$, wherein R represents an alkyl chain between 4 and 30 carbon atoms, (EO) represents one unit of ethylene oxide monomer and n has an average value between 0.5 and 20.

Fatty Acid or Salt Thereof

The term 'fatty acid' includes fatty acid or fatty acid salts. The fatty acids are preferably carboxylic acids which are often with a long unbranched aliphatic tail, which is either saturated or unsaturated. Suitable fatty acids include ethoxylated fatty acids. Suitable fatty acids or salts of the fatty acids for the present invention are preferably sodium salts, preferably C12-C18 saturated and/or unsaturated fatty acids more preferably C12-C14 saturated and/or unsaturated fatty acids and alkali or alkali earth metal carbonates preferably sodium carbonate.

Preferably the fatty acids are selected from the group consisting of lauric acid, myristic acid, palmitic acid, stearic acid, topped palm kernel fatty acid, coconut fatty acid and mixtures thereof.

Adjunct Ingredient

The liquid laundry detergent composition may comprise an adjunct ingredient, preferably selected from hueing dyes, polymers, surfactants, builders, dye transfer inhibiting agents, dispersants, enzymes, enzyme stabilizers, catalytic materials, bleach activators, polymeric dispersing agents, anti-redeposition agents, suds suppressors, aesthetic dyes, opacifiers, perfumes, perfume delivery systems, structurants, hydrotropes, processing aids, pigments, fatty acid and mixtures thereof.

Water-Soluble Film

The film of the present invention is soluble or dispersible in water and comprises at least one polyvinylalcohol or a copolymer thereof. Preferably, the water-soluble film comprises a blend of at least two different polyvinylalcohol homopolymers, at least two different polyvinylalcohol copolymers, at least one polyvinylalcohol homopolymer and at least one polyvinylalcohol copolymer or a combination thereof.

The water-soluble film preferably has a thickness of from 20 to 150 micron, preferably 35 to 125 micron, even more preferably 50 to 110 micron, most preferably from about 70 to 90 microns especially about 76 micron. By film thickness, we herein mean the thickness of the film prior to any deformation during manufacture.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Preferably, the water-soluble unit dose article comprises polyvinylalcohol.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol.

Preferred for use herein are PVA polymers which are from about 60% to about 98% hydrolysed, preferably about 80% to about 90% hydrolysed, to improve the dissolution characteristics of the material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP, measured as a 4% polymer solution in demineralized water at 20° C.

Preferably the film comprises a blend of at least two different polyvinylalcohol homopolymers and/or copolymers.

Most preferably the water soluble film comprises a blend of at least two different polyvinylalcohol homopolymers, especially a water soluble film comprising a blend of at least two different polyvinylalcohol homopolymers of different average molecular weight, especially a blend of 2 different polyvinylalcohol homopolymers having an absolute average viscosity difference $|\mu_2-\mu_1|$ for the first PVOH homopolymer and the second PVOH homopolymer, measured as a 4% polymer solution in demineralized water, in a range of 5 cP to about 15 cP, and both homopolymers having an average degree of hydrolysis between 85% and 95% preferably between 85% and 90%. The first homopolymer preferably has an average viscosity of 10 to 20 cP preferably 10 to 15 cP The second homopolymer preferably has an average viscosity of 20 to 30 cP preferably 20 to 25 cP. Most preferably the two homopolymers are blended in a 40/60 to a 60/40 weight % ratio.

Alternatively the water soluble film comprises a polymer blend comprising at least one copolymer comprising polyvinylalcohol and anionically modified monomer units. In particular the polymer blend might comprise a 90/10 to 50/50 weight % ratio of a polyvinylalcohol homopolymer and a copolymer comprising polyvinylalcohol and anionically modified monomer units. Alternatively the polymer blend might comprise a 90/10 to 10/90 weight % ratio of two different copolymers comprising polyvinylalcohol and anionically modified monomer units.

General classes of anionic monomer units which can be used for the PVOH copolymer include the vinyl polymerization units corresponding to monocarboxylic acid vinyl monomers, their esters and anhydrides, dicarboxylic monomers having a polymerizable double bond, their esters and anhydrides, vinyl sulfonic acid monomers, and alkali metal salts of any of the foregoing. Examples of suitable anionic monomer units include the vinyl polymerization units corresponding to vinyl anionic monomers including vinyl acetic acid, maleic acid, monoalkyl maleate, dialkyl maleate, monomethyl maleate, dimethyl maleate, maleic anyhydride, fumaric acid, monoalkyl fumarate, dialkyl fumarate, monomethyl fumarate, dimethyl fumarate, fumaric anyhydride, itaconic acid, monomethyl itaconate, dimethyl itaconate, itaconic anhydride, vinyl sulfonic acid, allyl sulfonic acid, ethylene sulfonic acid, 2-acrylamido-1-methylpropanesulfonic acid, 2-acrylamido-2-methylpropanesulfonic acid, 2-methylacrylamido-2-methylpropanesulfonic acid, 2-sufoethyl acrylate, alkali metal salts of the foregoing (e.g., sodium, potassium, or other alkali metal salts), esters of the foregoing (e.g., methyl, ethyl, or other $C_1$-$C_4$ or $C_6$ alkyl esters), and combinations thereof (e.g., multiple types of anionic monomers or equivalent forms of the same anionic monomer). In an aspect, the anionic monomer can be one or more acrylamido methylpropanesulfonic acids (e.g., 2-acrylamido-1-methylpropanesulfonic acid, 2-acrylamido-2-methylpropanesulfonic acid, 2-methylacrylamido-2-methylpropanesulfonic acid), alkali metal salts thereof (e.g., sodium salts), and combinations thereof. In an aspect, the anionic monomer can be one or more of monomethyl maleate, alkali metal salts thereof (e.g., sodium salts), and combinations thereof.

The level of incorporation of the one or more anionic monomer units in the PVOH copolymers is not particularly limited. In some aspects, the one or more anionic monomer units are present in a PVOH copolymer in an amount in a range of about 2 mol. % to about 10 mol. % (e.g., at least 2.0, 2.5, 3.0, 3.5, or 4.0 mol. % and/or up to about 3.0, 4.0, 4.5, 5.0, 6.0, 8.0, or 10 mol. % in various embodiments), individually or collectively.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, dipropylene glycol, sorbitol and mixtures thereof. Other additives may include water and functional detergent additives, including surfactant, to be delivered to the wash water, for example organic polymeric dispersants, etc.

The film may be opaque, transparent or translucent. The film may comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 ppm.

Process of Making

Those skilled in the art will be aware of processes to make the liquid laundry detergent composition of the present invention. Those skilled in the art will be aware of standard processes and equipment to make the liquid laundry detergent compositions.

Those skilled in the art will be aware of standard techniques to make the unit dose article. Standard forming processes including but not limited to thermoforming and vacuum forming techniques may be used.

Process of Washing Fabrics

One aspect of the present invention is a process of washing fabrics comprising the steps of contacting the unit dose article of the present invention with water such that the liquid laundry detergent composition is diluted in water by at least 400 fold to form a wash liquor, and contacting fabrics with said wash liquor.

The unit dose article of the present invention can be added to a wash liquor to which laundry is already present, or to which laundry is added. It may be used in an automatic washing machine operation and added directly to the drum or to the dispenser drawer. It may be used in combination with other laundry detergent compositions such as fabric softeners or stain removers.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

Film Plasticization Properties

The impact of varying solvent system on water soluble film plasticization properties was assessed within laundry detergent formulations suitable for water-soluble unit dose articles (low water). More particularly the relative ratio of 1,2-propanediol (P-Diol) and dipropyleneglycol (DPG) were varied to be within and outside the scope of the current invention. Film stress data tabulated below clearly show that film plasticization properties are better maintained within the laundry detergent formulation comprising a solvent system according to the invention (Example A), compared to solvent systems outside the scope of the invention (Comparative Examples A to C), preventing pouch floppiness or film brittleness accordingly. This film plasticization maintenance benefit was observed across 2 different laundry detergent base formulations, varying in relative anionic to nonionic surfactant content (Examples A and B).

The following base formulations were prepared using standard mixing techniques and equipment known to those skilled in the art.

| Ingredient (wt %) | Base I | Base II |
|---|---|---|
| Solvent system (described below) | 20.0 | 20.0 |
| Water | 10.0 | 10.0 |
| Monethanolamine | 10.4 | 8.4 |
| Linear alkylbenzene sulphonic acid | 22.1 | 16.9 |
| C12-14EO3S anionic surfactant | 15.0 | 11.3 |
| C12-14EO7 nonionic surfactant | 3.9 | 13.7 |
| Top palm kernel Fatty Acid | 6.1 | 5.1 |
| Citric acid | 0.7 | 0.7 |
| Ethoxylated polyethyleneimine (PEI600EO20) | 3.3 | 3.5 |
| Amphiphilic graft copolymer comprising terephthalate | 2.6 | 2.6 |
| Hydroxyethyldiphosphonic acid | 2.3 | 2.5 |
| Brightener 49 | 0.4 | 0.4 |
| Hydrogenated Castor Oil | 0.1 | 0.1 |
| Mg Cl2 | 0.3 | 0.3 |
| Minors (perfume, dye, suds suppressor, enzyme, antioxidant) | Balance | Balance |

The examples for testing were prepared as follows, wherein the solvent system for each example is described together with the base formulation to which it was added.

| Solvent | Wt % | | | | |
|---|---|---|---|---|---|
| | Example A | Comparative Example A | Comparative Example B | Comparative Example C | Example B |
| | Base formulation | | | | |
| systems | I | I | I | I | II |
| P-diol | 12 wt % | 16 wt % | 4 wt % | — | 12 wt % |
| DPG | 4 wt % | — | 12 wt % | 16 wt % | 4 wt % |
| Glycerol | 4 wt % | 4 wt % | 4 wt % | 4 wt % | 4 wt % |

An 85 μm thick polyvinylalcohol based water soluble film, as present in Aria 3-in-1 PODS unit dose laundry products, as commercialized by the Procter and Gamble company in the UK in January 2016, was used to assess film plasticization dependency upon varying solvent system.

Film plasticization impact of varying solvent systems in a base laundry detergent formulation was defined through measuring film stress upon 100% strain. A test film was subjected to an ageing experiment through immersing the film in respective example and comparative example formulations as described above, and the film stress upon 100% strain post-immersion data were compared versus data of the virgin film (not immersed in the example formulations).

A film sample of 12 cm by 17 cm was immersed within 150 ml of test liquid by 1) selecting a flat clean inert glass recipient, 2) covering the bottom of the recipient with a thin layer of the example formulation to be tested, 3) carefully spreading the film to be tested on the liquid, 4) gently pushing air bubbles trapped under the film towards the sides, 5) gently pouring the remaining example formulation on top of the film, in such a way that the film is fully immersed into the liquid, ensuring that the film is free of wrinkles and that no air bubbles are in contact with the film, and 6) closing the glass container and 7) storing the closed container for 5 days at 35° C. followed by 1 night at 21° C. and 40% relative humidity. After ageing, the film was removed from the formulation example and gently wiped dry with a soft dry liquid absorbing paper, followed immediately by measuring the post film immersion stress-strain profile.

The film stress upon strain profile was measured using an Instron instrument (system ID #5567J4072 available from the Instron company). Film plasticization properties were defined at constant temperature and relative humidity conditions (21±1° C. and 45±5% RH). The gauge length was set to 25 mm 5 strips of 1 inch width and 12 cm long were cut out of the piece of film in machine direction, i.e. the direction the film moves during the production process (the direction of film movement during manufacture is defined by the direction in which the film is unwound from the roll in which it has been shipped from the manufacturer). The stress-strain curve was defined for these 5 replicates and the average stress at 100% strain value for a strain speed of 500 mm/min is reported below.

| | stress @ 100% strain [MPa] (post film immersion) | | | | | |
|---|---|---|---|---|---|---|
| | virgin | Example A | Comparative Example A | Comparative Example B | Comparative Example C | Example B |
| average | 11.4 | 11.5 | 9.7 s | 16.7 s | 16.7 s | 11.1 |
| standard deviation | 0.2 | 0.6 | 0.4 | 0.9 | 0.8 | 1.1 |

As can be seen from the data, film immersed in the formulations of the present invention maintained substantially the same plasticization properties as the virgin film. However, the comparative examples were either over, or under plasticised.

Liquid Stability Profile

Liquid stability testing was conducted in closed glass vials fresh and after 2 weeks storage at 5, 10, 20 and 32° C. and assessed visually for presence/absence of haziness. Example A remained fully transparent while some degree of haziness was observed within Example B both fresh and upon 2 weeks storage at 5, 10, 20 and 32° C.

As demonstrated, careful balance of the ratio of anionic to non-ionic surfactant as well as presence of the solvent system of the present invention resulted in both desired film plasticization characteristics and liquid stability characteristics.

"The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

"Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern."

"While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention."

What is claimed is:

1. A water-soluble unit dose article comprising a water-soluble film comprising at least one polyvinylalcohol or a copolymer thereof and a liquid laundry detergent composition, wherein the liquid laundry detergent composition comprises;

a. between about 30% and about 43% by weight of the liquid laundry detergent composition of an anionic surfactant selected from linear alkylbenzene sulphonate, alkoxylated alkyl sulphate, or a mixture thereof;

b. a non-ionic surfactant selected from a fatty alcohol alkoxylate, an oxo-synthesised fatty alcohol alkoxylate, or a mixture thereof;

c. 1,2-propanediol;

d. dipropylene glycol;

e. glycerol wherein the total weight percentage of the 1,2-propanediol and dipropylene glycol is between about 5% and about 25% by weight of the liquid laundry detergent composition, wherein the glycerol is present between about 2% and about 10% by weight of the liquid laundry detergent composition wherein the weight ratio of 1,2-propanediol to dipropylene glycol is between about 1:1 and about 10:1; and wherein the weight ratio of anionic surfactant to non-ionic surfactant is between 5:1 and 15:1.

2. The water-soluble unit dose article according to claim 1, wherein the anionic surfactant comprises linear alkylbenzene sulphonate and ethoxylated alkyl sulphate.

3. The water-soluble unit dose article according to claim 2 wherein the anionic surfactant comprises linear alkylbenzene sulphonate and ethoxylated alkyl sulphate in a weight ratio of linear alkylbenzene sulphonate to ethoxylated alkyl sulphate of between about 3:1 and about 1:1.

4. The water-soluble unit dose article according to claim 1, wherein the liquid laundry detergent composition comprises between 34% and 40% by weight of the composition of the anionic surfactant.

5. The water-soluble unit dose article according to claim 1, wherein the liquid laundry detergent comprises a fatty acid or salt thereof.

6. The water-soluble unit dose article according to claim 5 wherein the liquid laundry detergent composition comprises between 3% and 10% by weight of the liquid laundry detergent composition of a fatty acid or salt thereof.

7. The water-soluble unit dose article according to claim 1 comprising between about 0.5% and 20%, by weight of the unit dose article of water.

8. The water-soluble unit dose article according to claim 1 wherein the total weight percentage by weight of the liquid laundry detergent composition of 1,2-propanediol and dipropylene glycol is between 10% and 20%.

9. The water-soluble unit dose article according to claim 1 wherein the liquid laundry detergent composition comprises an alkanolamine.

10. The water-soluble unit dose article according to claim 9 wherein the liquid laundry detergent composition comprises between 5% and 15%, by weight of the liquid laundry detergent composition of the alkanolamine.

11. The water-soluble unit dose article according to claim 1 wherein the liquid laundry detergent composition has a pH between 6 and 10.

12. The water-soluble unit dose article according to claim 1 wherein the liquid laundry detergent composition comprises an adjunct ingredient selected from hueing dyes, polymers, surfactants, builders, dye transfer inhibiting agents, dispersants, enzymes, enzyme stabilizers, catalytic materials, bleach activators, polymeric dispersing agents, anti-redeposition agents, suds suppressors, aesthetic dyes, opacifiers, perfumes, perfume delivery systems, structurants, hydrotropes, processing aids, pigments and mixtures thereof.

13. The water-soluble unit dose article according to claim 1 wherein the water-soluble film comprises a blend of at least two different polyvinylalcohol homopolymers, at least two different polyvinylalcohol copolymers, at least one polyvinylalcohol homopolymer and at least one polyvinylalcohol copolymer or a combination thereof.

14. The water-soluble unit dose article according to claim 1 comprising at least two internal compartments, wherein the liquid laundry detergent composition is comprised in at least one of the compartments.

15. A process of washing fabrics comprising the steps of contacting the unit dose article according to claim 1 with water such that the liquid laundry detergent composition is diluted in water by at least 400 fold to form a wash liquor, and contacting fabrics with said wash liquor.

* * * * *